US005660377A

United States Patent [19]

Specht

[11] Patent Number: 5,660,377

[45] Date of Patent: Aug. 26, 1997

[54] SELF-TENSIONING PERMANENT FENCE SYSTEM

[75] Inventor: Paul Specht, Wilmette, Ill.

[73] Assignee: The Tensar Corporation, Atlanta, Ga.

[21] Appl. No.: 593,809

[22] Filed: Jan. 30, 1996

[51] Int. Cl.[6] ..... E04H 17/14

[52] U.S. Cl. ..... 256/54; 256/19; 256/45; 256/47

[58] Field of Search ..... 256/37, 32, 47, 256/45, 12.5, 13.1, DIG. 1, 54, 19, 48, 49, 56, 1, 24, 73

[56] References Cited

U.S. PATENT DOCUMENTS

| | | | |
|---|---|---|---|
| 10,015 | 9/1853 | Ross . | |
| 42,166 | 4/1864 | Blanchard . | |
| 108,925 | 11/1870 | Middleton . | |
| 196,086 | 10/1877 | Hall . | |
| 197,806 | 12/1877 | Walter . | |
| 377,672 | 2/1888 | Eubank, Jr. . | |
| 534,545 | 2/1895 | Breadner . | |
| 620,244 | 2/1899 | McGlashan . | |
| 629,529 | 7/1899 | Simmons . | |
| 684,213 | 10/1901 | Fogelsong | 256/49 X |
| 760,407 | 5/1904 | Soper . | |
| 833,358 | 10/1906 | Wales . | |
| 836,043 | 11/1906 | Kempf, Jr. . | |
| 1,105,369 | 7/1914 | Muller | 256/37 X |
| 1,122,829 | 12/1914 | Wernimont . | |
| 1,625,716 | 4/1927 | Edwards . | |
| 1,633,619 | 6/1927 | Ward . | |
| 1,773,128 | 8/1930 | Barrus . | |
| 1,927,303 | 9/1933 | Benedict . | |
| 2,872,161 | 2/1959 | Olson | 256/12.5 X |
| 2,887,333 | 5/1959 | Shield | 256/54 X |
| 3,173,661 | 3/1965 | Kruger . | |
| 3,273,862 | 9/1966 | Miller . | |
| 3,410,527 | 11/1968 | Uroshevich | 256/32 |
| 3,415,491 | 12/1968 | Wilcox | 256/54 X |
| 3,469,822 | 9/1969 | O'Brien . | |
| 3,540,587 | 11/1970 | Dawborn . | |
| 3,604,686 | 9/1971 | Parisien | 256/32 |
| 3,767,167 | 10/1973 | Rasmussen . | |
| 3,913,889 | 10/1975 | Nugent et al. . | |
| 4,031,284 | 6/1977 | Ingraham . | |
| 4,072,295 | 2/1978 | Roberts . | |
| 4,083,535 | 4/1978 | Britt . | |
| 4,191,361 | 3/1980 | Jensen | 256/24 X |
| 4,249,357 | 2/1981 | Cornou . | |
| 4,299,507 | 11/1981 | Collins, II . | |
| 4,374,798 | 2/1983 | Mercer . | |
| 4,576,364 | 3/1986 | O'Fearna | 256/73 X |
| 4,756,511 | 7/1988 | Wright, III | 256/12.5 |
| 4,809,955 | 3/1989 | Veilleux | 256/19 X |
| 4,852,194 | 8/1989 | Langan . | |
| 4,919,394 | 4/1990 | Otte et al. . | |
| 5,184,800 | 2/1993 | Tabler . | |
| 5,201,497 | 4/1993 | Williams et al. . | |
| 5,409,196 | 4/1995 | Specht . | |

FOREIGN PATENT DOCUMENTS

| | | | |
|---|---|---|---|
| 0062419 | 10/1982 | European Pat. Off. . | |
| 1434716 | 11/1968 | Germany | 256/32 |
| 2207834 | 6/1978 | Germany . | |
| 3631553 | 3/1988 | Germany . | |
| 21652 | 12/1895 | United Kingdom . | |
| 1589864 | 5/1981 | United Kingdom . | |
| 2068036 | 8/1981 | United Kingdom . | |

*Primary Examiner*—Harry C. Kim

*Attorney, Agent, or Firm*—Jacobson, Price, Holman & Stern, PLLC

[57] ABSTRACT

A self-tensioning fencing system includes a tensioner bar which is mounted directly to a structural support such as a fence post using standard nails, screws or bolts as required according to the type of a particular fence post. The tensioner bar includes a projection for pressing plastic fencing material into a recess in the fence post to allow the plastic fencing material to be tensioned across the structural support posts. A trim cap extrusion is shaped complementary to a side of the tensioner bar, opposite to the projection for engaging with the fencing material, so as to engage and cover the tensioner bar. A post cap covers the upper end of the fence post, tensioner bar and trim cap extrusion.

24 Claims, 12 Drawing Sheets

SELF-TENSIONING PERMANENT FENCE SYSTEM

FIELD OF THE INVENTION

The present invention relates to a self-tensioning fencing installation system for plastic fencing material, such as uniaxial and biaxial grid material, knitted mesh and net materials, and even sheet plastic materials.

BACKGROUND OF THE INVENTION

Present fencing systems require erection of structural support posts at some predetermined spacing after which a roll of plastic fencing material is secured at one end to a post and then tensioned from a structural support post at an opposite end so as to stretch the plastic fencing material across the plurality of structural support posts. After stretching, the plastic fencing material is secured to the intermediary structural support posts. Dependent upon the length of the fence to be erected, a great deal of force is required to tension an elongated fence. Accordingly, power driven tools are required to tension an elongated fence.

In an attempt to overcome such disadvantages, a self-tensioning fencing system as disclosed in U.S. Pat. No. 5,409,196 ("the '196 patent") commonly assigned with the instant application and incorporated herein in its entirety by reference, has been developed. According to the invention of the '196 patent, it is possible to tension a plastic grid material or any plastic fencing material across a plurality of structural support posts without the need for full tensioning of the entire length of the plastic fencing material prior to the plastic fencing material being secured to the structural support posts. To achieve this goal, a fastening system is used which is adaptable to both existing and new structural support posts of all common types, such as wood, steel tube and rolled steel sections. An installation method is used to tension the plastic fencing material without the need for specialized equipment after only a manual pre-tensioning of the plastic fencing material.

The self-tensioning fencing system of the '196 patent includes a mounting batten, made of plastic or metal, which is mounted directly to a structural support such as a fence post using standard nails, screws or bolts as required according to the type of a particular fence post. Alternatively, the mounting batten is produced integral with a support post. The mounting batten may be a solid or a thick walled hollow section plastic extrusion or a metal form. The mounting batten is secured to the structural support post so as to space the plastic grid material away from the support post to allow the plastic grid material to be tensioned at a spacing from the structural support posts.

In the system of the '196 patent, a channel batten may be made of pre-coated cold rolled steel or rigid plastic and mounted over the mounting batten and serves to clamp plastic fencing material between the mounting batten and the channel batten. The channel batten when drawn tight against the mounting batten, serves not only to firmly attach the fencing material to the support post but acts as a tensioning device.

The amount of tensioning take-up provided by the channel batten is dependent upon the respective cross-sectional dimensions of the mounting batten and the channel batten. In a typical application, the tensioning capability of the channel batten is in the range of ⅜ of an inch to ⅞ of an inch at each support post, and preferably ⅝ of an inch, which is variable dependent upon the plastic grid material used and the size and shape of the mounting batten and the channel batten. Since full tension is not applied to the entire length of plastic fencing material until each channel batten is secured to a respective mounting batten, the system of the '196 patent can accommodate a varying terrain.

A preferred form of grid-like sheet material used between fence posts, known as an integral geogrid, is commercially available from The Tensar Corporation of Atlanta, Ga. ("Tensar") and is made by the process disclosed in U.S. Pat. No. 4,374,798 ("the '798 patent"), the subject matter of which is incorporated herein in its entirety by reference. Preferably, uniaxially-oriented geogrid materials as disclosed in the '798 patent are used as fencing materials according to this invention, although biaxial geogrids or grid materials that have been made by different techniques such as woven, knitted or netted grid materials formed of various polymers including the polyolefins, polyamides, polyesters and the like or fiberglass, may be used. In addition, it is possible that felt-like fabrics including woven or non-woven, solid or perforated geofabrics, geonets, or even composite materials including some form of geofabric and/or geogrid laminate or solid plastic sheet materials may be used as the tensioned fencing material according to this invention. All of such materials are sometimes referred to herein and in the appended claims as "grid-like sheets of material", "polygrid" or "geogrid", whether they are formed with apertures or not.

SUMMARY OF THE INVENTION

It is therefore an object of the present invention to provide an improved self-tensioning fencing system for use with a plastic fencing material.

It is another object of the present invention to provide structural support posts shaped to receive a tensioner bar, over which a trim cap extrusion is placed to aesthetically conceal the tensioner bar.

It is still yet another object of the present invention to tension extended lengths of plastic fencing material across separated structural support posts by securing a tensioner bar to the post and thereafter securing a trim cap extrusion to the tensioner bar with a post cap on top on the post and rails extending between spaced posts with a top rail clip securing the fencing material to the top rail.

It is still a further object of the preset invention to tension extended lengths of plastic fencing material across separated structural support posts by securing a tensioner bar to the posts with the plastic fencing material captured between the tensioner bar and the posts, adjacent posts being connected to each other by rails engaged with cleats on the posts and the fencing material being held to the rail by a rail clip extending between posts.

According to the present invention, a permanent, aesthetically pleasing, self-tensioning fencing system is provided. In accordance with the principles of the present invention, a fencing system is erected, including a plurality of fence posts, preferably separated by a distance of 8 feet from post center to post center. Each post is preferably 87.25 inches long which accommodates a 4 foot width span of polygrid material and 3 foot post footing depth. Also, a top post extension of 0 to 2.5 inches is provided and a bottom ground clearance for the polygrid of 0 to 2 inches is thereby possible.

On one face of the post is a recess for accommodating a tensioner bar which is secured in the recess of the post with geogrid located between the post and tensioner bar. When the tensioner bar is screwed into the post with screws spaced 16 inches on center along the tensioner bar, the side walls of a projection of the tensioner bar presses the plastic grid material along the side walls of the recess in a post so as to impose a tension across the plastic grid material between successively adjacent support posts.

In one embodiment of the present invention, horizontally extending rails are located between adjacent support posts. The rails will preferably have a length of 98 inches and be of a hollow rectangular configuration, preferably measuring 1.5 inches wide by 2.8 inches high.

To secure rails between adjacent support posts, a cleat is secured to the sides of the post by screws and the rail is secured to the cleat, also by screws. The cleats may also be used for joining support braces to the posts, with the braces being anchored in the ground and extending at an angle to the side of the post.

In the embodiment where a top rail is used, a U-shaped clip is placed over the top rail and over the top edge of the geogrid to hide the exposed upper edge of the geogrid. A screw passing through the top rail and into the cleat holds the top rail to the support post and secures the top rails in place at their opposite ends.

As a cosmetic cover for the tensioner bar, a trim cap extrusion is provided which includes a smooth flat surface on one side and two cut-out portions on the opposite sides. The cut-out portions are of a complementary shape to the ends of two arms of the tensioner bar so that the trim cap extrusion may be slid downwardly over the two arms of the tensioner bar to cover the tensioner bar from view. The trim cap extrusion hides the tensioner bar and the recess of the post into which the geogrid has been pressed to tension the geogrid between adjacent support posts. Looking from the side of the flat side of the trim cap extrusion, the geogrid appears as if it extends straight across between adjacent posts without any interruptions or dips for stretching of the geogrid.

To finish off the appearance of the assembled fencing system, a post cap having a peaked top surface is fitted on top of the upper-most end of the post and around the upper-most end of the trim cap extrusion. The post cap includes a projection on one side so as to cover the upper end of the trim cap extrusion, tensioner bar and fence post. The post cap includes a peaked roof so as to provide an appearance of pointed posts when viewing the fencing system from afar.

In an alternate embodiment of the present invention, the top rail, top rail clips and cleats for holding the top rail to the support posts are omitted so that only geogrid extends between adjacent support posts.

These and other objects of the invention, as well as many of the intended advantages thereof, will become more readily apparent when reference is made to the following description taken in conjunction with the accompanying drawings.

DETAILED DESCRIPTION OF THE PREFERRED EMBODIMENTS

Figure 1:
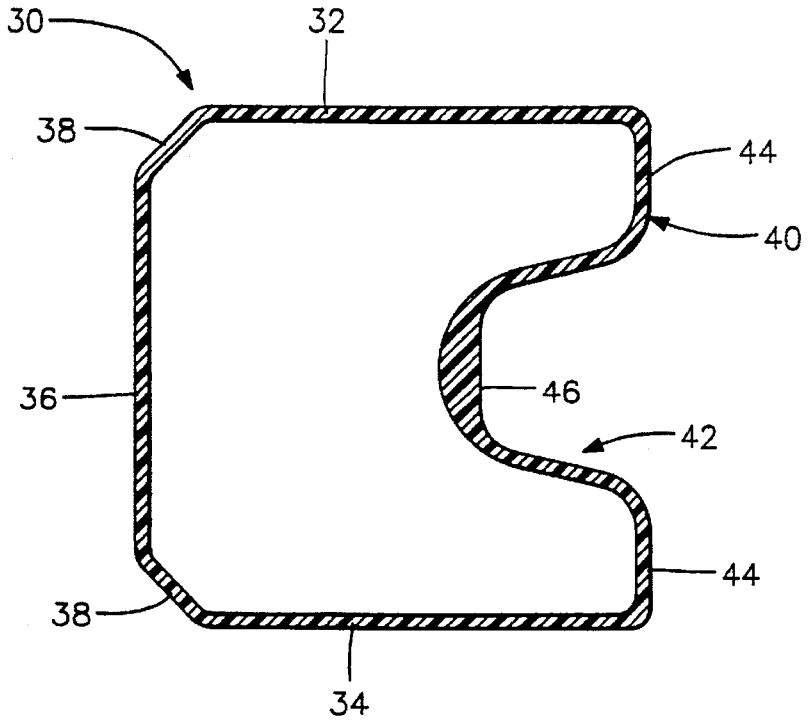
FIG. 1 is a transverse cross-sectional view through a support fence post having a recess in one side face.

In describing preferred embodiments of the invention illustrated in the drawings, specific terminology will be resorted to for the sake of clarity. However, the invention is not intended to be limited to the specific terms so selected, and it is to be understood that each specific term includes all technical equivalents which operate in a similar manner to accomplish a similar purpose.

Although specific dimensional relationship are discussed herein it is to be understood that these dimensions are illustrative, and the individual components can be made in any size without departing from the instant inventive concepts.

Also, while each of the basic components of the fence system of the instant invention are preferably extruded or molded from a suitable plastic, it is evident that the material of these elements, as well as their method of manufacture, can be readily modified by those with ordinary skill in this art while retaining the basic concepts of this invention.

With reference to the drawings, in general, and to FIGS. 1 through 20, in particular, the individual components of a self-tensioning fencing system according to this invention are described. While the preferred embodiment is shown and described with reference to a biaxially-oriented polymer geogrid such as disclosed in the '798 patent, alternative grid-like sheet materials may be substituted therefor, including grid-like sheet materials manufactured using weaving, knitting or netting techniques, likewise, solid sheet fencing materials or composites may be used as well.

Figure 2:
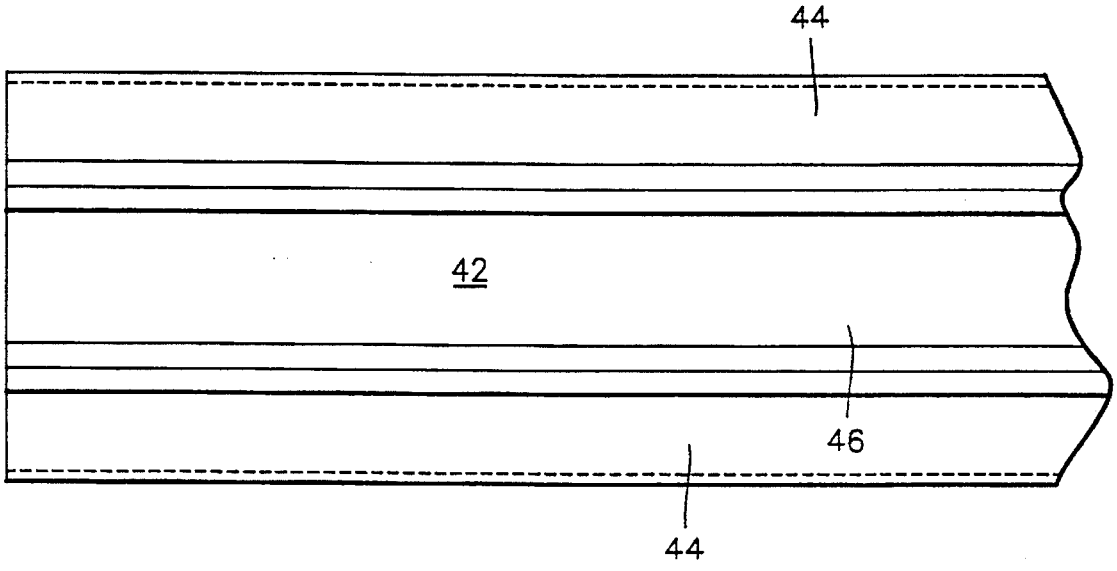
FIG. 2 is a fragmentary side elevational view of the face of the fence post of FIG. 1.

In FIGS. 1 and 2, a hollow fence post 30 is shown. Fence post 30 includes two opposite side walls 32, 34 extending parallel to each other. Rear wall 36 is connected to side walls 32, 34 by angled connection pieces 38. Opposite to rear wall 36 is front wall 40 which includes a recess opening 42. Recess opening 42 tapers inwardly until reaching flat bottom wall 46.

Front wall portions 44 extend perpendicular to side walls 32, 34 and, in contrast to rear wall 36, do not include any angled connection pieces. This will be discussed in additional detail when referring to the post cap.

Figure 3:
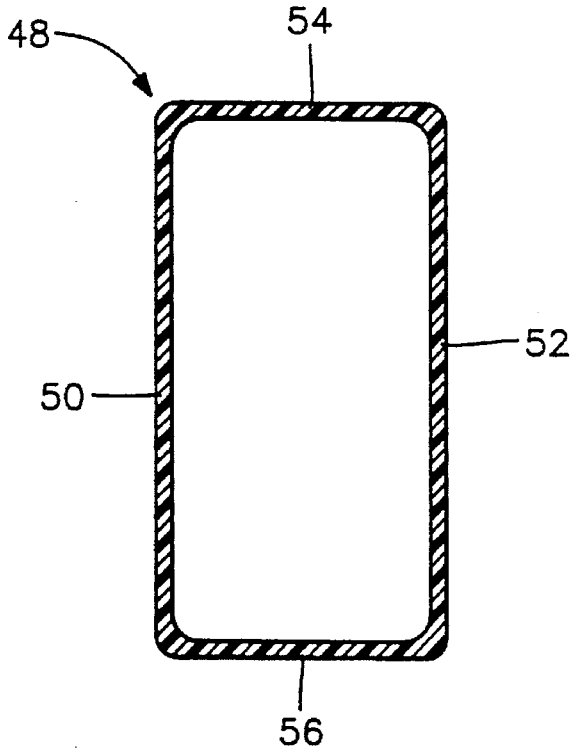
FIG. 3 is a transverse cross-sectional view through a top rail for use in one embodiment of this invention.
Figure 4:
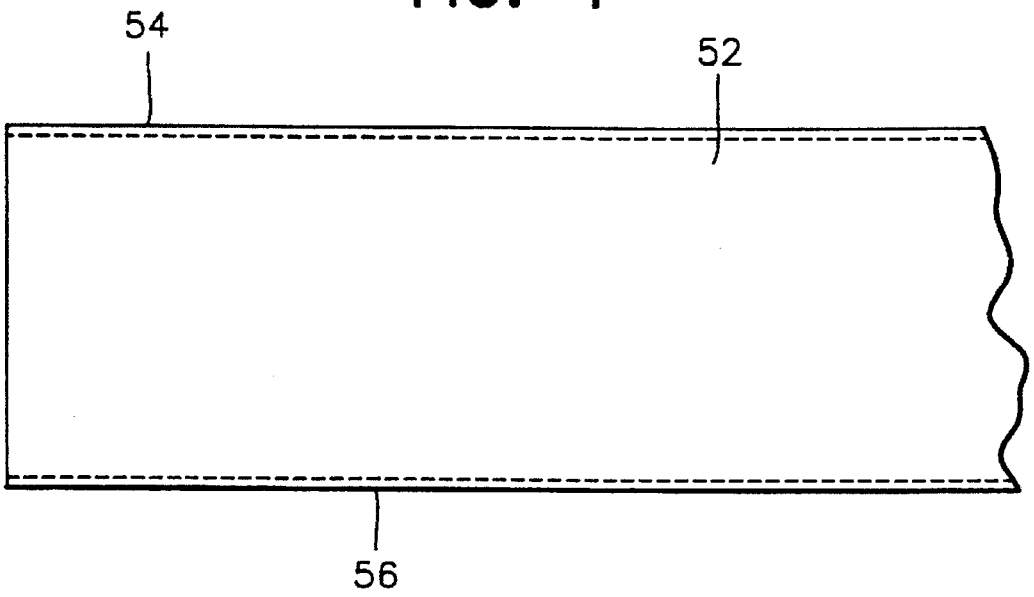
FIG. 4 is a fragmentary side elevational view of the top rail of FIG. 3.

In FIGS. 3 and 4, a hollow rectangularly shaped top rail 48 is shown having parallel side walls 50 and 52, top wall 54 and bottom wall 56.

Figure 5:
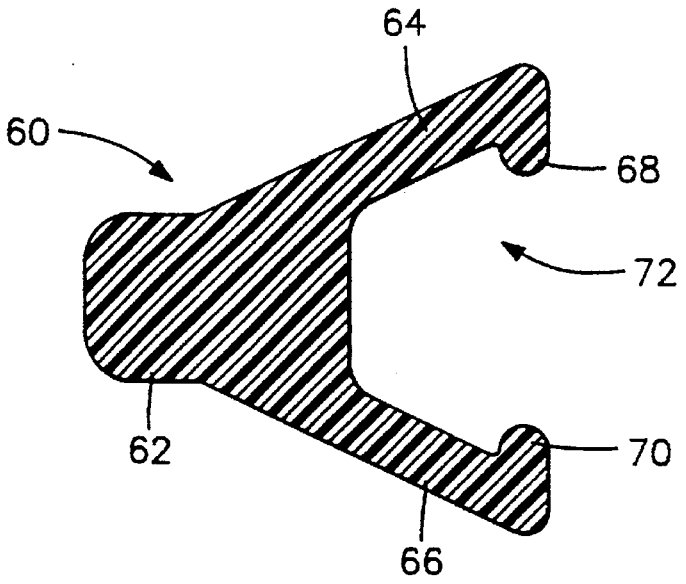
FIG. 5 is a transverse cross-sectional view through a tensioner bar according to this invention, including a projection on one side for insertion into the recess in the side face of a fence post and two arms on the opposite side for cooperating with a trim cap extrusion.
Figure 6:
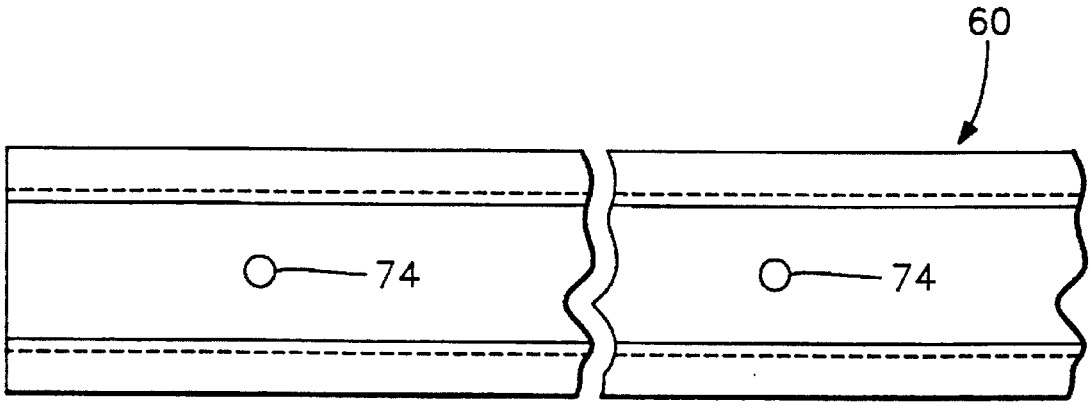
FIG. 6 is a fragmentary side elevational view of the tensioner bar of FIG. 5 shown on a reduced scale from the side having the two arms projecting outwardly and illustrating 16 inch on-center holes for securing the tensioner bar to the fence post.

In FIGS. 5 and 6, tensioner bar 60 is shown. Tensioner bar 60 is preferably 50.5 inches long and includes a projection 62 shaped to fit within the recess opening 42 of the fence post 30. At the opposite end of the tensioner bar 60 are located two outwardly extending arms 64, 66 each terminating in an inwardly extending projection 68, 70, respectively. A gap 72 is formed between the projections 68, 70. Spaced along the length of the tensioner bar 60 are screw holes 74 through which a screw will pass to secure the tensioner bar to the fence post with the projection 62 extending into the recess opening 42 of the fence post 30.

Figure 7:
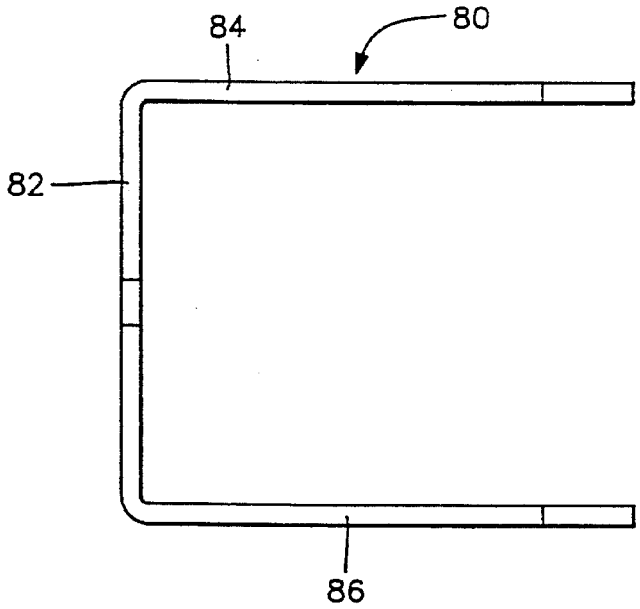
FIG. 7 is a top plan view of a cleat according to this invention for securing a top rail or a brace to a fence post.
Figure 8:
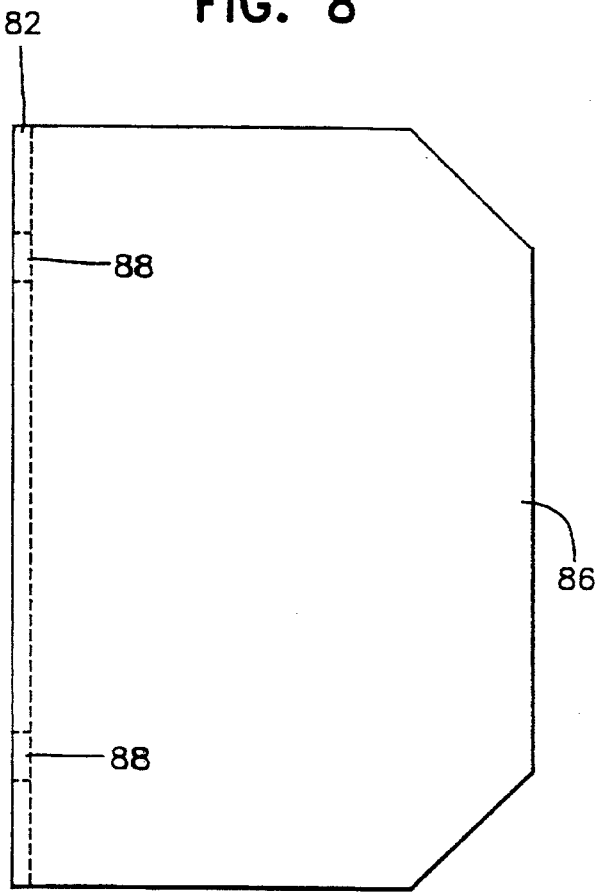
FIG. 8 is a side elevational view of the cleat of FIG. 7.
Figure 9:
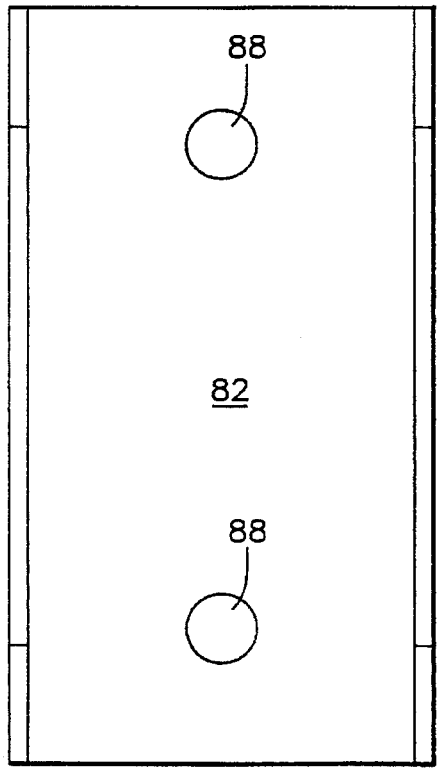
FIG. 9 is an end elevational view of the cleat of FIG. 7 showing the holes for securing the cleat to a fence post.

In FIGS. 7 through 9, a U-shaped cleat 80 is shown. The cleat includes a cross-piece 82 interconnecting two arms 84, 86. In the cross-piece are located two screw holes 88 for securing the cleat to a side wall 32, 34 of the fence post 30.

Figure 10:
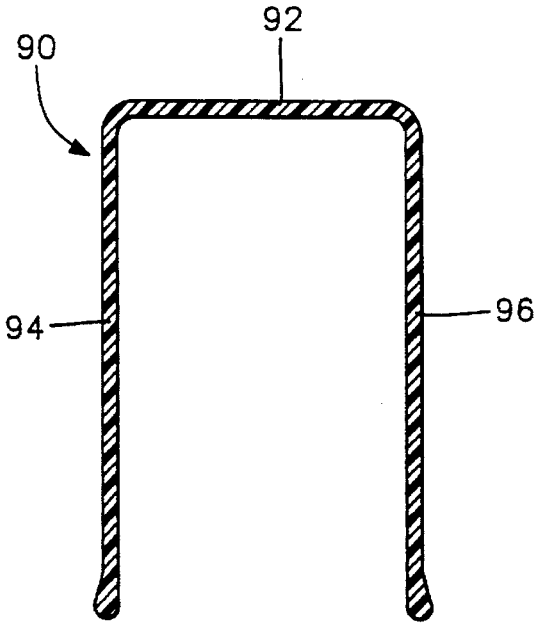
FIG. 10 is a transverse cross-sectional view through a top rail clip according to this invention for securing the upper end of geogrid extending between adjacent fence posts to a top rail.
Figure 11:
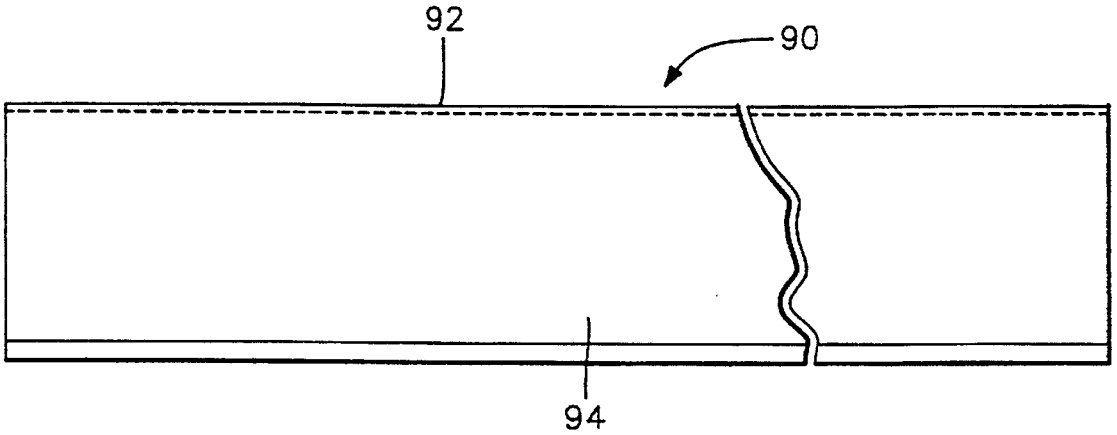
FIG. 11 is a fragmentary side elevational view of the top rail clip of FIG. 10.

In the embodiment of the present invention in which a top rail extends between adjacent fence posts, a top rail clip 90 as shown in FIGS. 10 and 11 is used. Top rail clip 90 is U-shaped and includes a cross-piece 92 and two side arms 94, 96. The free ends of the arms 94, 96 diverge slightly outwardly to facilitate sliding of the clip 90 over a top rail and around the upper edge of a section of geogrid.

Figure 12:
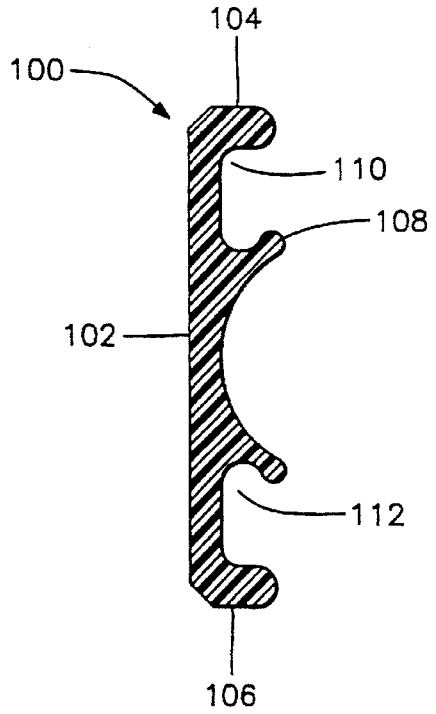
FIG. 12 is a transverse cross-sectional view through a trim cap extrusion according to this invention, having two recesses shaped complementary to the ends of the arms of the tensioner bar for slidingly cooperating with the tensioner bar to conceal the tensioner bar and the recess of the fence post in use.
Figure 13:
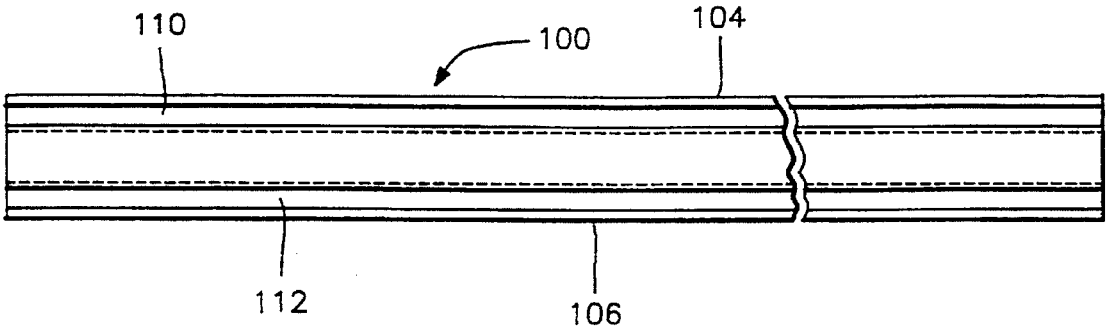
FIG. 13 is a fragmentary side elevational view of the trim cap extrusion of FIG. 12.
Figure 14:
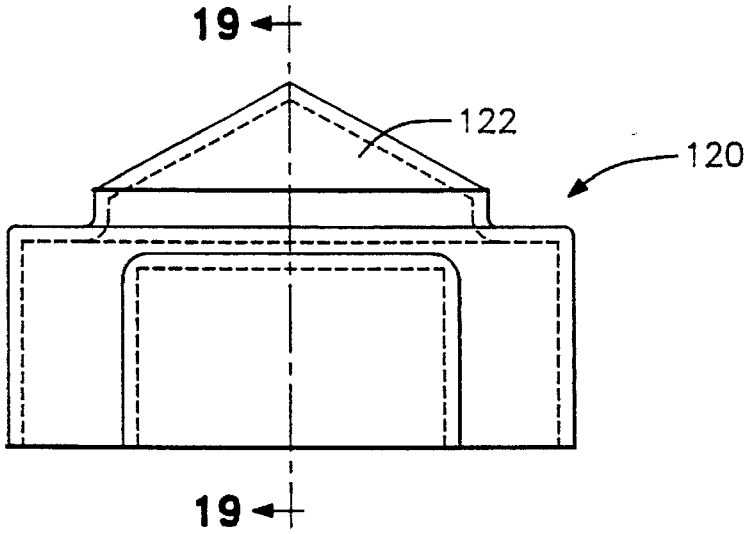
FIG. 14 is a side elevational view of a post cap according to this invention.
Figure 15:
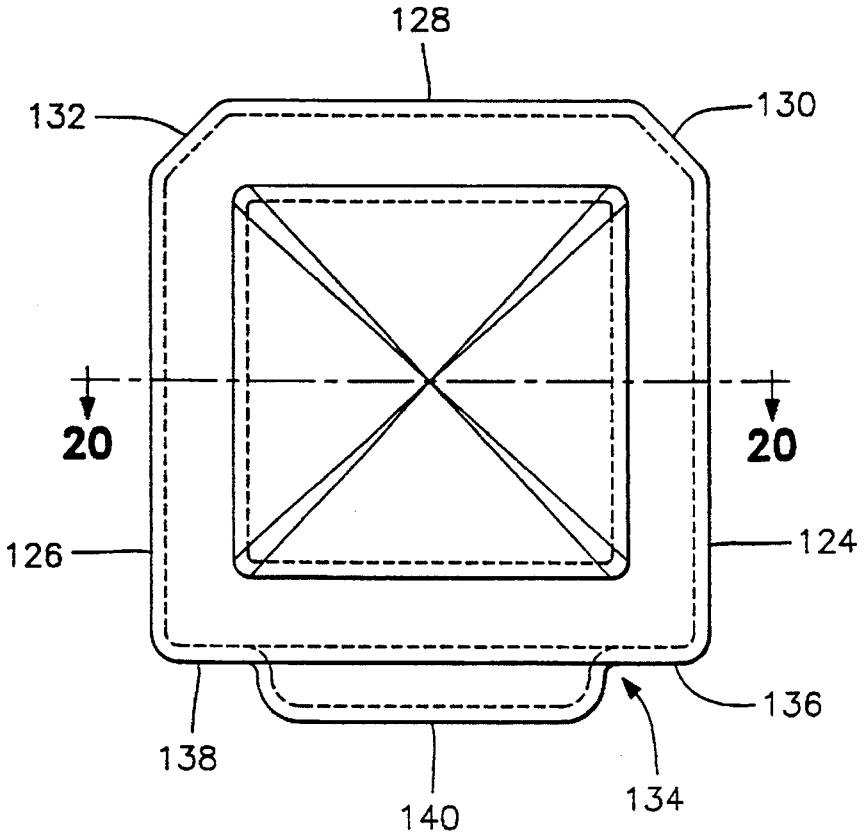
FIG. 15 is a top plan view of the post cap of FIG. 14 showing a projection for covering the trim cap extrusion and tensioner bar secured to a fence post.
Figure 16:
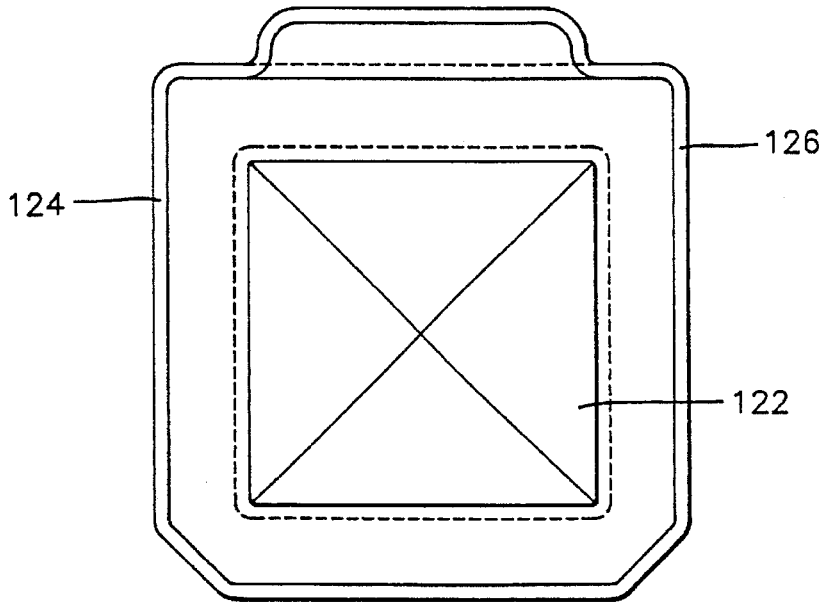
FIG. 16 is a bottom plan view of the post cap.
Figure 17:
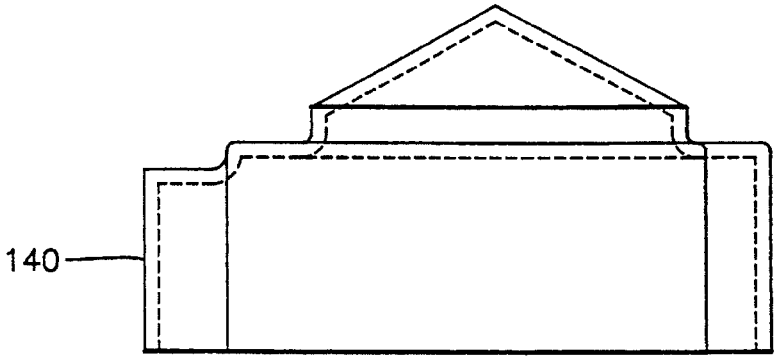
FIG. 17 is a side elevational view of the post cap turned 90° from the view in FIG. 14.
Figure 18:
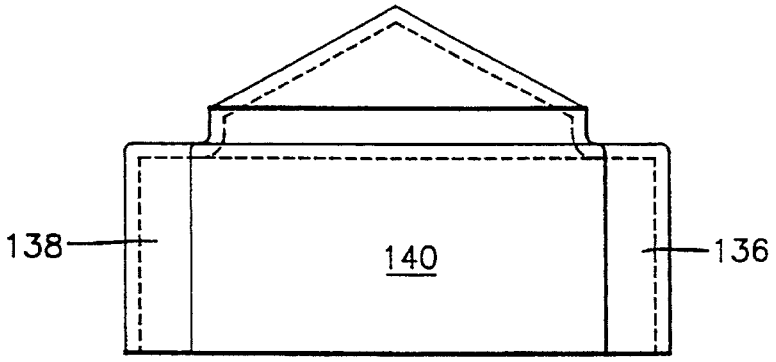
FIG. 18 is side elevational view of the post cap turned 180° from the view in FIG. 14.

In FIGS. 12 and 13, a trim cap extrusion 100 is shown. The trim cap extrusion includes a flat front face 102 curving around to two opposed side faces 104, 106. The rear face 108 of the trim cap extrusion 100 is specially designed to cooperate with the arms and projections of the tensioner bar 60. Accordingly, the rear face 108 of the trim cap extrusion includes two recesses 110, 112 which are shaped complementary to the projections 68 and 70 located at the ends of arms 64, 66 of the tensioner bar 60. By the intended complementary shape of the recesses 110, 112 and the projections 68, 70, the trim cap extrusion may be slid over the tensioner bar to fit along the entire height of the tensioner bar and thereby hide the tensioner bar behind flat face 102, seen when viewing the front wall 40 of the fence post.

Figure 19:
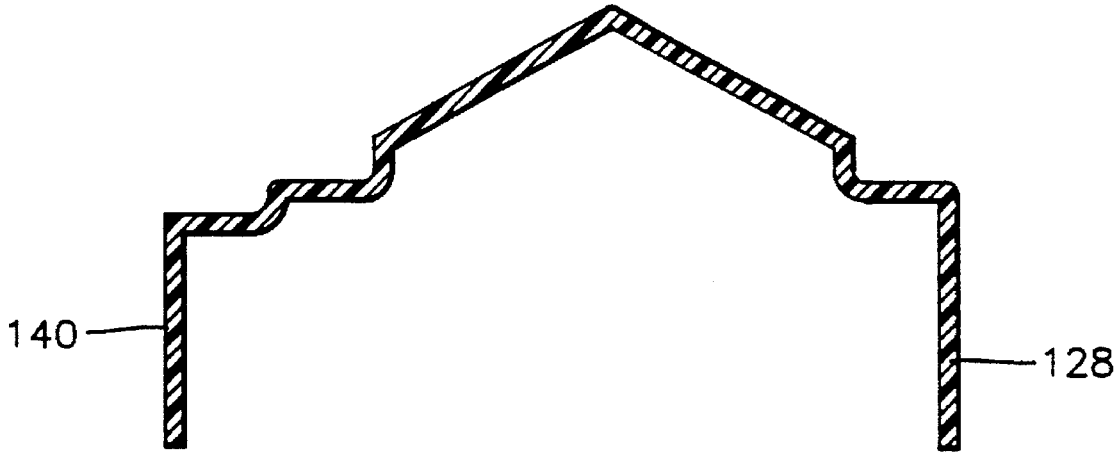
FIG. 19 is a cross-sectional view taken along line 19—19 of FIG. 14.
Figure 20:
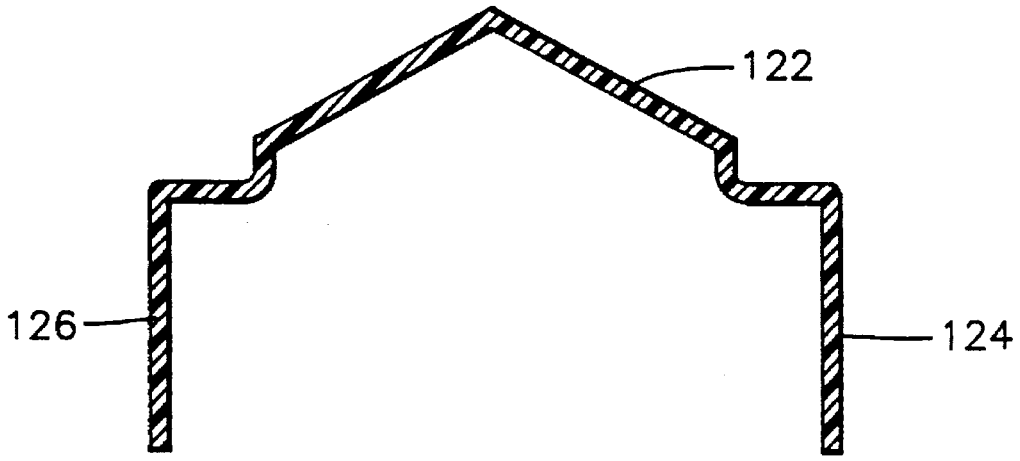
FIG. 20 is a cross-sectional view taken along line 20—20 of FIG. 15.

In FIGS. 14 through 20, a post cap 120 is shown having a peaked roof or top 122. The post cap 120 includes two opposed side walls 124, 126. A rear wall 128 is connected to side walls 124, 126 by connecting portions 130, 132. The angle between the rear wall 128 and the side walls 124, 126 by which connecting portions 130 and 132 extend is the same as the angle occupied by connection pieces 38 between rear wall 36 and side walls 32, 34 of the fence post 30. Similarly, at front wall 134 of the post cap there are short wall sections 136, 138, which correspond to front wall portions 44 of fence post 30. Post cap 120 includes a projecting cap portion 140 extending from front face 134 as shown in FIG. 19. Projecting portion 140 projects beyond short wall sections 136, 138 to accommodate the covering of the tensioner bar and the trim cap extrusion mounted on the tensioner bar.

The placement of the post cap on the fence post in its proper orientation, with the tensioner bar and trim cap extrusion in place, is facilitated by the connecting portions 130, 132 aligning with the connection pieces 38 as well as the front wall portions 44 of fence post 30. Further, the projecting portion 140 fits over the tensioner bar and the trim cap extension as explained below.

Figure 21:
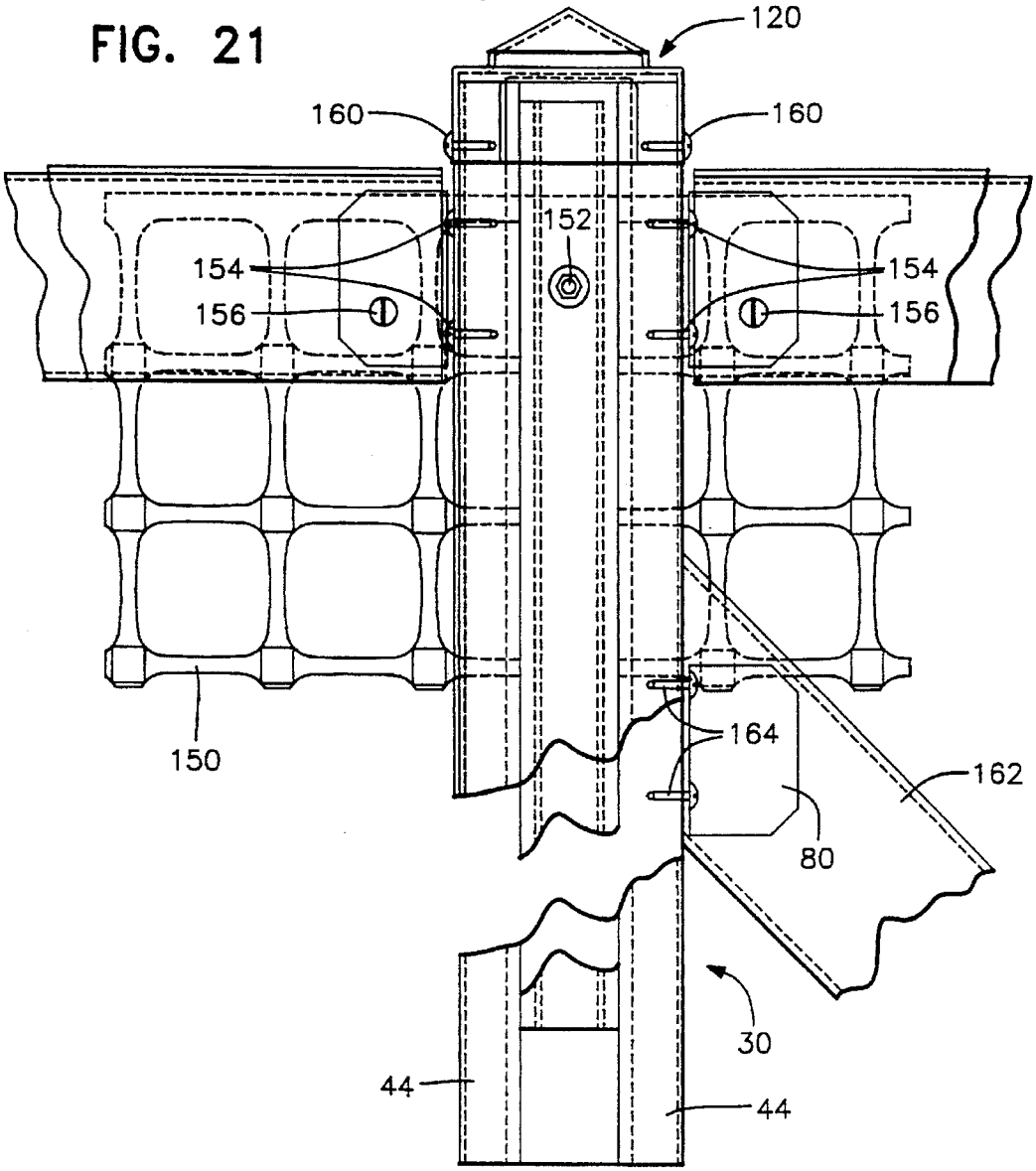
FIG. 21 is a fragmentary side elevational view of the assembled fencing system according to the present invention with a section of biaxially oriented geogrid used as a fencing material and extending across the face of the fence post, the tensioner bar securing the geogrid to the fence post, the trim cap extrusion covering the tensioner bar and a post cap covering the top end of the fence post as well as the top end of the tensioner bar and trim cap extrusion. Top rails extend in opposite directions from the fence post and the upper edge of the geogrid is covered by a top rail clip. The top rails are secured to the fence post by a cleat with another cleat securing a diagonal brace to the side of the fence post.

One embodiment of an assembly of the various components of the present invention to provide an aesthetically pleasing fencing system is illustrated in FIGS. 21 through 23 and 25. In FIG. 21, a section of grid-like sheet material 150 is shown extending across front face 40 of fence post 30. The tensioner bar 60 is secured to the fence post by screw 152 so that the projection 62 pushes a portion of the grid-like sheet material 150 into recess opening 42 and against wall 46.

Trim cap extension 100 fits around the arms 64, 66 and projections 68, 70 so as to conceal the tensioner bar 60 and the front face 40 of the fence post, except for front wall portions 44 which extend beyond the width of the trim cap extension 100.

Figure 22:
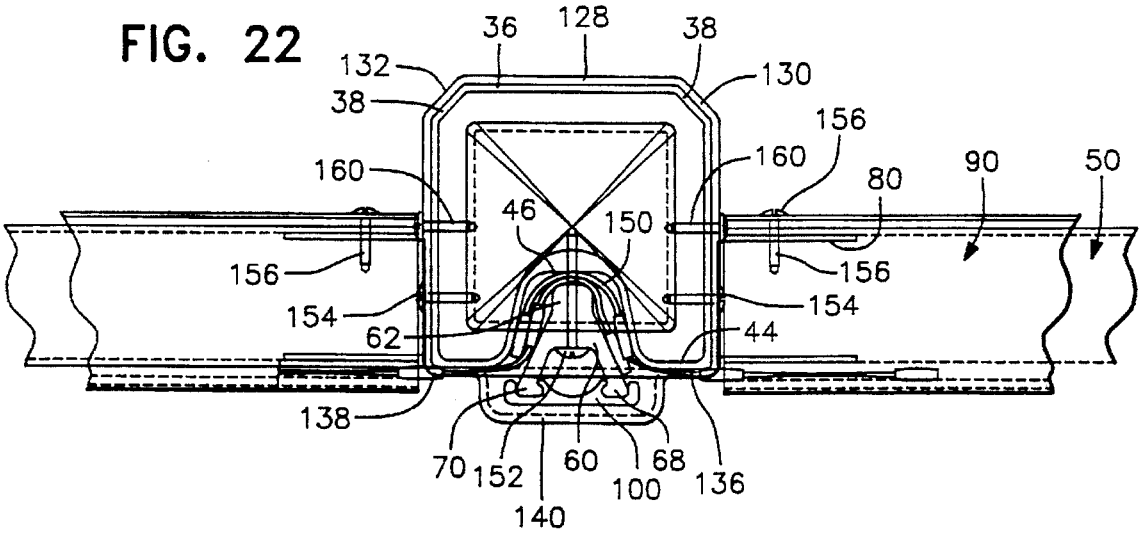
FIG. 22 is a fragmentary top plan view of the assembled fencing system shown in FIG. 21.
Figure 23:
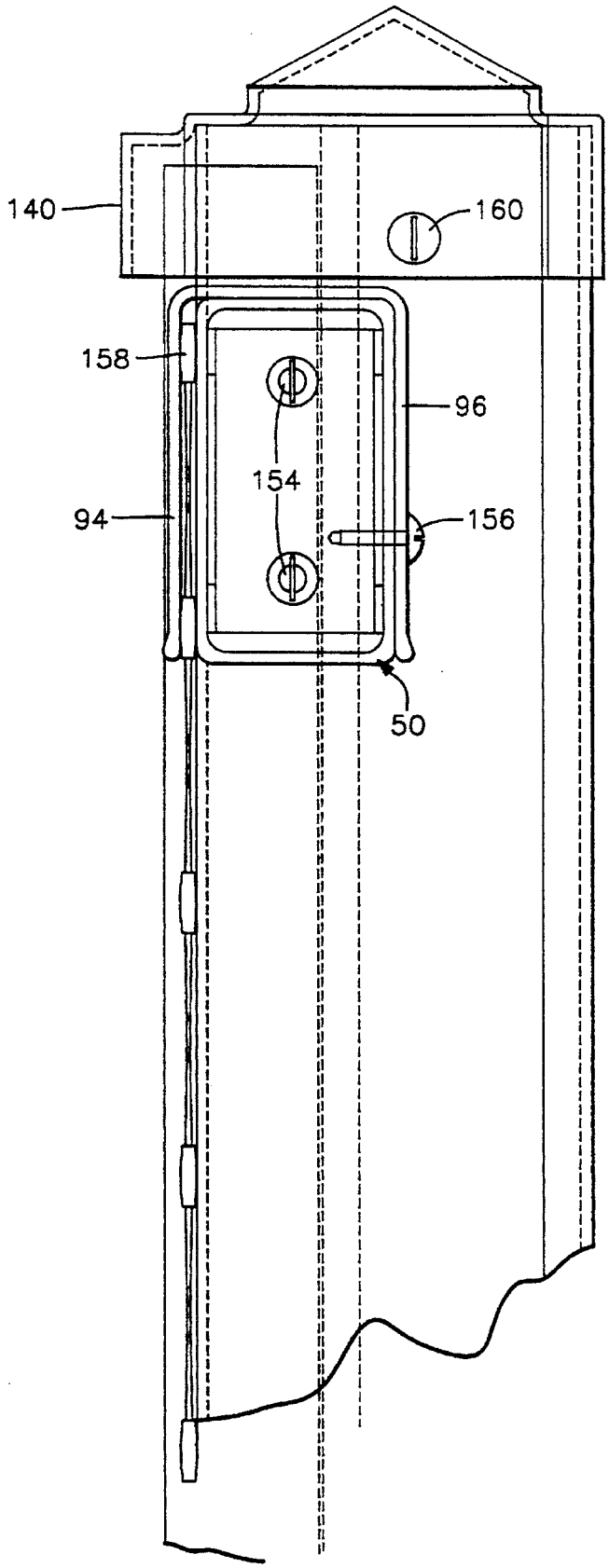
FIG. 23 is a side elevational view of a top rail connected to a fence post with the upper edge of a section of geogrid covered by a top rail clip. A post cap covers the tensioner bar holding the geogrid to the fence post and also covers a trim cap extrusion secured to the tensioner bar.
Figure 25:
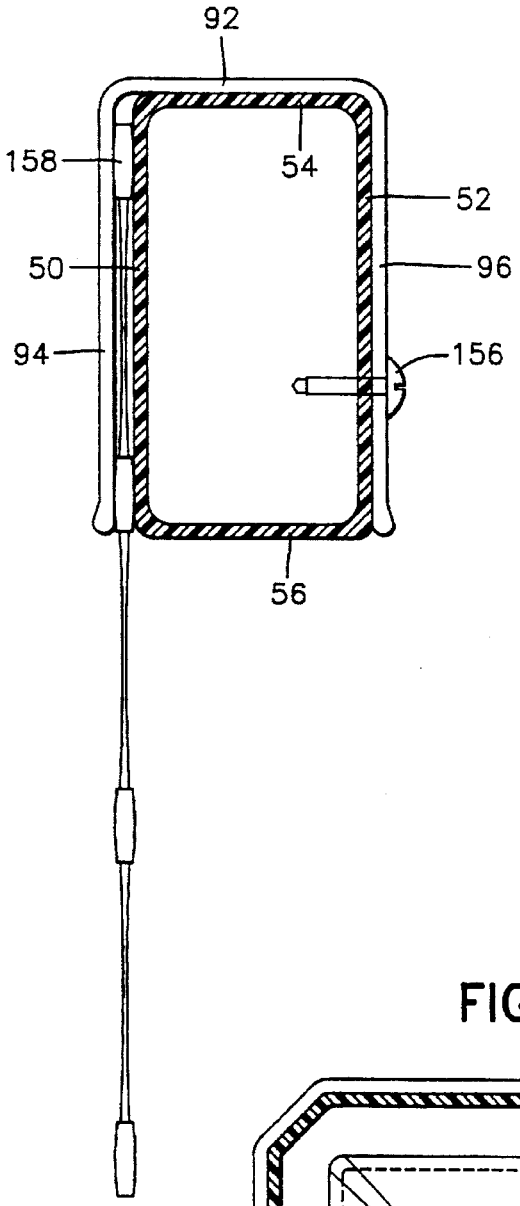
FIG. 25 is a vertical cross-sectional view illustrating the securing of the upper edge of a section of geogrid to a top rail by a top rail clip and a screw extending through the top rail clip and into the top rail to hold the top rail clip in place.

In the embodiment where the top rail 50 extends between adjacent fence posts, a cleat 80 is secured to opposite sides 32, 34 of the fence post by screws 154. The cleat 80 fits inside of the rail 50 as shown in FIGS. 22 and 23 and is held in place on the cleat 80 by screw 156 passing through the rear wall 96 of the top rail clip 90. The front wall 94 of the top rail clip covers an upper edge 158 of the grid-like sheet material 150 to hold its top edge in place. This is best shown in FIG. 25.

To complete the assembly, the post cap 120 is placed over the upper end of the fence post 30, tensioner bar 60 and trim cap extrusion 100. The post cap 120 will only fit over these three components in a single orientation due to a complementary shape configuration of the combination of the fence post, tensioner bar and trim cap extension, the projecting portion 140 fitting over the tensioner bar 60 and then cap extrusion 100. Screws 160 passing through the side walls 124, 126 secure the post cap to the top of the fence post 30.

If a side support brace 162 is required, a cleat 80 is secured to the side wall 32, for example, of the fence post 30, by two screws 164. The brace 162 is fitted over the cleat 80 and secured thereto by a screw (not shown).

Figure 24:
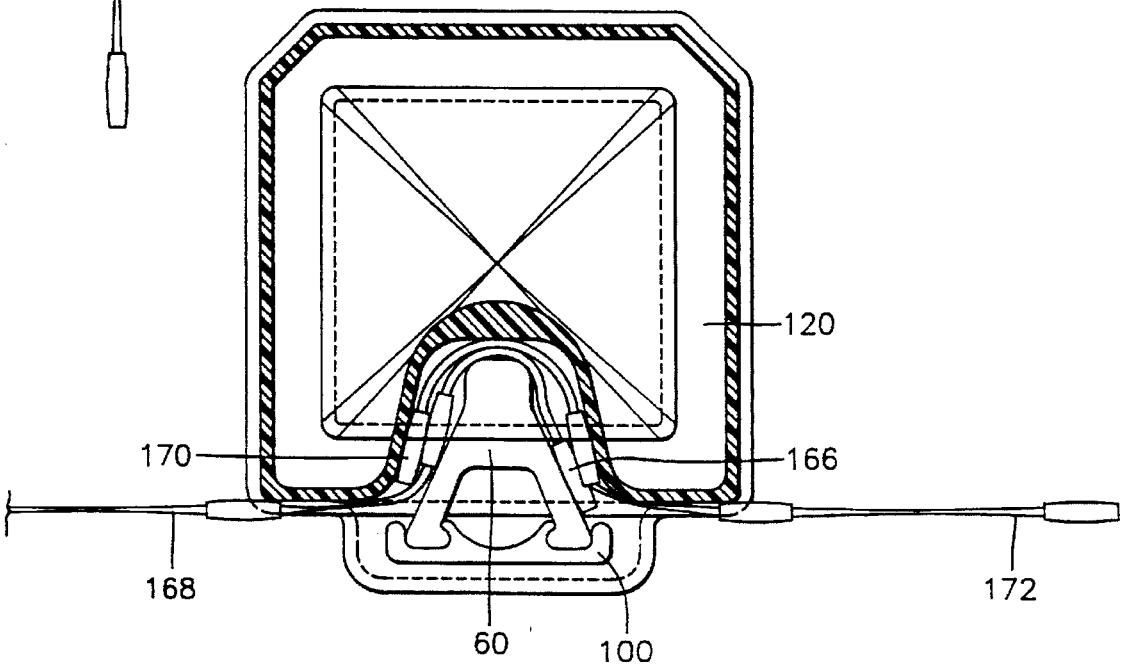
FIG. 24 illustrates a transverse cross-sectional view of an alternate embodiment of the present invention where the top rails have been omitted and the end of two sections of geogrid are secured to the fence post by the tensioner bar, covered by a trim cap extrusion with the post cap covering the upper ends of the fence post, tensioner bar and trim cap extrusion.

In an alternate embodiment of the present invention, the top rail 50 and top rail clip 90 are omitted as shown in FIG. 24. Otherwise, the same components are used. In FIG. 24, it is additionally illustrated that the end 166 of a first section of geogrid 168 is located in a recess 42 of the fence post as well as the end 170 of a second section 172 of geogrid. It is thereby possible to form an infinite length of fencing by cutting the ends of a length of geogrid so that it is captured in the recess 42 of the fence post 30 by a tensioner bar 60.

Accordingly, according to the present invention, an aesthetically pleasing fence post system is formed in which connections of geogrid to the fence post are hidden from plain view. The system may include a top rail extending between adjacent fence posts or the top rail may be omitted.

The foregoing description should be considered as illustrative only of the principles of the invention. Since numerous modifications and changes will readily occur to those skilled in the art, it is not desired to limit the invention to the exact construction and operation shown and described, and, accordingly, all suitable modifications and equivalents may be resorted to, falling within the scope of the invention.

I claim :

1. A self-tensioned fence comprising:

a plurality of spaced fence posts each of which includes portions defining a recess therein, each fence post including a tensioner bar extending into said recess of said fence post, a length of plastic fencing material extending between said fence posts and interposed between each said fence post and said tensioner bar associated therewith, and a trim cap extrusion mounted on and engaged by each tensioner bar, said trim cap extrusion including a portion shaped complementary to a portion of said tensioner bar to removably secure said trim cap extrusion on said tensioner bar so as to cover said tensioner bar and at least a portion of said fence post associated therewith.

2. A self-tensioned fence as claimed in claim 1, wherein each of said tensioner bars includes portions defining projections thereon, said trim caps including recesses shaped complementary to said projections on said tensioner bars.

3. A self-tensioned fence as claimed in claim 2, wherein said trim cap slidingly engages said tensioner bar.

4. A self-tensioned fence as claimed in claim 1, further including a rail extending between adjacent fence posts.

5. A self-tensioned fence as claimed in claim 4, further including a rail clip securing said plastic fencing material to each rail.

6. A self-tensioned fence as claimed in claim 5, wherein said rail clip extends along a length of said rail.

7. A self-tensioned fence as claimed in claim 4, further including cleats secured to said fence posts, said rail being connected to said fence posts by said cleats.

8. A self-tensioned fence as claimed in claim 7, wherein said cleats fits inside of said rails.

9. A self-tensioned fence as claimed in claim 1, further including a post cap covering an upper end of each fence post, and its associated tensioner bar and trim cap.

10. A self-tensioned fence as claimed in claim 9, wherein said post cap includes a configuration shaped complementary to the upper end of said fence post, said tensioner bar and said trim cap, when assembled.

11. A self-tensioning fencing system comprising:

a plurality of fence posts, each fence post including a longitudinal recess in one surface, a plurality of tensioner bars, each tensioner bar having a projection for extending into said recess of one of said fence posts to trap a length of plastic fencing material therebetween and tension the plastic fencing material between adjacent fence posts, and a trim cap for said tensioner bar, said trim cap being mounted on and engaged by said tensioner bar and cooperating with complementary shaped surfaces of said tensioner bar to removably secure said trim cap on said tensioner bar so as to cover said tensioner bar and at least a portion of said fence post when said tensioner bar is secured to said fence post and said trim cap is secured to said tensioner bar.

12. A self-tensioning fencing system as claimed in claim 11, further including rails connectable between adjacent fence posts.

13. A self-tensioning fencing system as claimed in claim 12, further including rail clips for holding said plastic fencing material against said rails.

14. A self-tensioning fencing system as claimed in claim 13, wherein said rail clip extends along a length of said rail.

15. A self-tensioning fencing system as claimed in claim 12, further including cleats for holding said rails to said fence posts.

16. A self-tensioning fencing system as claimed in claim 11, further including a post cap for covering said fence posts, said tensioner bars and said trim caps, when assembled.

17. A self-tensioning fencing system as claimed in claim 16, wherein said post cap is shaped complementary to an upper end of an assembly of said fence post, said tensioner bar and said trim cap.

18. A self-tensioning fencing system comprising:

a plurality of fence posts, each fence post including a longitudinal recess in one surface, a length of plastic fencing material extending between adjacent fence posts, a plurality of tensioner bars, each tensioner bar having a projection for extending into said recess of one of said fence posts to trap said length of plastic fencing material therebetween and tension the plastic fencing material between adjacent fence posts, and a trim cap for said tensioner bar, said trim cap being mounted on and engaged by said tensioner bar and cooperating with complementary shaped surfaces of said tensioner bar to removably secure said trim cap on said tensioner bar so as to cover said tensioner bar and at least a portion of said fence post when said tensioner bar is secured to said fence post and said trim cap is secured to said tensioner bar.

19. A self-tensioning fencing system as claimed in claim 18, further including a post cap for covering said fence post, said tensioner bar and said trim cap, when assembled.

20. A self-tensioning fencing system as claimed in claim 18, wherein said post cap is shaped complementary to an upper end of an assembly of said fence post, said tensioner bar and said trim cap.

21. A self-tensioned fence comprising:

a plurality of spaced fence posts each of which includes portions defining a recess therein, each fence post including a tensioner bar extending into said recess of said fence post, a length of plastic fencing material extending between said fence posts and interposed between each fence post and said tensioner bar associated therewith, a trim cap extrusion mounted on each tensioner bar to cover said tensioner bar and at least a portion of said fence post associated therewith, and a post cap including a projection from one side for covering an upper end of each fence post, and said tensioner bar and said trim cap associated therewith.

22. A self-tensioned fence as claimed in claim 21, wherein said post cap includes a configuration shaped complementary to the upper end of said fence post, said tensioner bar and said trim cap, when assembled.

23. A self-tensioning fencing system comprising:

a plurality of fence posts, each fence post including a longitudinal recess in one surface, a plurality of tensioner bars, each tensioner bar having a projection for extending into said recess of one of said fence posts to trap a length of plastic fencing material therebetween and tension the plastic fencing material between adjacent fence posts, a trim cap for said tensioner bar, said trim cap cooperating with complementary shaped surfaces of said tensioner bar so as to cover said tensioner bar and at least a portion of said fence post when said tensioner bar is secured to said fence post and said trim cap is secured to said tensioner bar, and a post cap including a projection extending from one side, said post cap covering said fence posts, said tensioner bars and said trim caps, when assembled.

24. A self-tensioning fencing system as claimed in claim 23, wherein said post cap is shaped complementary to an upper end of an assembly of said fence post, said tensioner bar and said trim cap.

* * * * *